US008792661B2

(12) United States Patent
Apfel et al.

(10) Patent No.: US 8,792,661 B2
(45) Date of Patent: Jul. 29, 2014

(54) HEARING AIDS, COMPUTING DEVICES, AND METHODS FOR HEARING AID PROFILE UPDATE

(75) Inventors: Russell J. Apfel, Austin, TX (US); David Mathew Landry, Austin, TX (US); Donald Coplin, Austin, TX (US); Samir Ibrahim, Silver Spring, MD (US)

(73) Assignee: Audiotoniq, Inc., Austin, TX (US)

( * ) Notice: Subject to any disclaimer, the term of this patent is extended or adjusted under 35 U.S.C. 154(b) by 388 days.

(21) Appl. No.: 13/007,986

(22) Filed: Jan. 17, 2011

(65) Prior Publication Data

US 2011/0176697 A1 Jul. 21, 2011

Related U.S. Application Data

(60) Provisional application No. 61/301,812, filed on Feb. 5, 2010, provisional application No. 61/296,634, filed on Jan. 20, 2010.

(51) Int. Cl.
*H04R 25/00* (2006.01)

(52) U.S. Cl.
USPC ..... 381/315; 381/314

(58) Field of Classification Search
USPC ..... 381/314, 315, 312
See application file for complete search history.

(56) References Cited

U.S. PATENT DOCUMENTS

| | | | | |
|---|---|---|---|---|
| 4,622,440 | A | 11/1986 | Slavin | |
| 4,845,755 | A | 7/1989 | Busch | |
| 5,303,306 | A | 4/1994 | Brillhart | |
| 5,524,150 | A | 6/1996 | Sauer | |
| 5,608,803 | A | 3/1997 | Magotra et al. | |
| 5,721,783 | A | 2/1998 | Anderson | |
| 5,727,070 | A | 3/1998 | Coninx | |
| 6,078,675 | A | 6/2000 | Bowen-Nielsen et al. | |
| 7,010,133 | B2 | 3/2006 | Chalupper | |
| 7,020,296 | B2 * | 3/2006 | Niederdrank | 381/315 |
| 7,167,571 | B2 | 1/2007 | Bantz et al. | |
| 7,324,650 | B2 | 1/2008 | Fischer | |
| 7,451,256 | B2 | 11/2008 | Hagen | |
| 7,529,545 | B2 | 5/2009 | Rader et al. | |
| 7,715,576 | B2 | 5/2010 | Ribic | |
| 7,773,763 | B2 * | 8/2010 | Pedersen | 381/321 |
| 7,787,647 | B2 | 8/2010 | Hagen et al. | |
| 7,826,631 | B2 | 11/2010 | Fischer | |
| 7,853,028 | B2 | 12/2010 | Fischer | |
| 8,195,230 | B2 * | 6/2012 | Jung et al. | 455/557 |
| 2005/0281424 | A1 | 12/2005 | Rass | |
| 2006/0198530 | A1 | 9/2006 | Fischer et al. | |
| 2008/0240477 | A1 | 10/2008 | Howard et al. | |
| 2009/0074216 | A1 * | 3/2009 | Bradford et al. | 381/315 |

(Continued)

OTHER PUBLICATIONS

Resound Alera: End User Brochure, instructional brochure, 2010, M101100-GB-10.02 Rev.A, GN ReSound Group, USA 7 pages.

*Primary Examiner* — Brian Ensey

(74) *Attorney, Agent, or Firm* — Lee & Hayes, PLLC

(57) ABSTRACT

A method includes receiving a data at a hearing aid during operation of the hearing aid and selectively updating a hearing aid profile in response to receiving the data to produce a modified hearing aid profile. The method further includes applying the modified hearing aid profile using a processor of the hearing aid to shape an audio output.

20 Claims, 5 Drawing Sheets

(56) References Cited

U.S. PATENT DOCUMENTS

| | | | | |
|---|---|---|---|---|
| 2010/0054511 | A1 | 3/2010 | Wu et al. | |
| 2010/0266151 | A1* | 10/2010 | Glatt et al. | 381/314 |
| 2011/0200214 | A1* | 8/2011 | Knox et al. | 381/314 |
| 2011/0237295 | A1* | 9/2011 | Bartkowiak et al. | 455/556.1 |
| 2011/0249839 | A1* | 10/2011 | Mindlin et al. | 381/314 |
| 2011/0293123 | A1* | 12/2011 | Neumeyer et al. | 381/314 |
| 2012/0002829 | A1* | 1/2012 | Iwano et al. | 381/314 |
| 2012/0183163 | A1* | 7/2012 | Apfel | 381/314 |

* cited by examiner

HEARING AIDS, COMPUTING DEVICES, AND METHODS FOR HEARING AID PROFILE UPDATE

CROSS REFERENCE TO RELATED APPLICATION(S)

This application is a non-provisional of and claims priority to U.S. Provisional patent application No. 61/301,812, entitled "HEARING AID PROFILE ADJUSTMENT SYSTEM," and filed on Feb. 5, 2010, which is incorporated herein by reference in its entirety. Further, this application is a non-provisional of and claims priority to U.S. Provisional patent application No. 61/296,634, entitled "SYSTEM AND METHOD OF PROVIDING A HEARING AID ALERT BASED ON SOUND SAMPLING," and filed on Jan. 20, 2010, which is incorporated herein by reference in its entirety.

FIELD

This disclosure relates generally to hearing aids, and more particularly to hearing aids, computing devices, and methods for hearing aid profile selection.

BACKGROUND

Hearing deficiencies can range from partial to complete hearing loss. Often, an individual's hearing ability varies across the range of audible sound frequencies, and many individuals have hearing impairment with respect to only select acoustic frequencies. For example, an individual's hearing loss may be greater at higher frequencies than at lower frequencies, or vice versa.

Hearing aids have been developed to alleviate the effects of hearing losses in individuals. Conventionally, hearing aids range from ear pieces configured to amplify sounds to configurable hearing devices offering adjustable operational parameters that can be configured by a hearing specialist to enhance the performance of the hearing aid. Parameters, such as volume or tone, often can be easily adjusted, and many hearing aids allow for the individual users to adjust these parameters. In such instances, the hearing aid adjustment is often applied to both hearing aids. For example, an adjustment in tone or volume is applied substantially equally to both hearing aids.

In instances where the individual's hearing loss varies across frequencies, such hearing aids can be tuned by an audiologist, for example, to compensate for the unique variations of the individual's hearing loss.

Typically, a hearing health professional takes measurements using calibrated and specialized equipment to assess an individual's hearing capabilities in a variety of sound environments, and then adjusts the hearing aid parameters based on the calibrated measurements. Subsequent adjustments to the hearing aid can require a second exam and further calibration by the hearing health professional, which can be costly and time intensive.

To account for various acoustic environments, in some instances, the hearing health professional may create multiple hearing profiles for the user for use in different sound environments. Such hearing profiles include frequency and amplitude adjustments that can be applied to sound-related signals to compensate for a particular user's hearing deficiencies and to filter frequencies or reduce the volume in certain acoustic environments. Unfortunately, such hearing profiles may not take into account the variety of acoustic environments to which the user may be exposed. In some instances, it is possible that none of the various stored hearing profiles accurately reflects the user's acoustic environment. Moreover, even if an appropriate profile is available, the user may not know that a hearing profile is available that better fits the particular acoustic environment or the user may make a less than ideal selection by choosing a non-optimal hearing aid profile for the acoustic environment.

Higher end (higher cost) hearing aid models sometimes include logic configured to select between the stored profiles. Since robust processors consume significant battery power, hearing aid manufacturers often choose lower-end and lower-cost processors, which consume less power but which also have less processing power. Thus, the hearing aid may have insufficient processing power to characterize the acoustic environment effectively in order to make an appropriate selection.

To make hearing aid profile selections, instruction sets executed by such processors may rely on a variety of assumptions that can lead to less than desirable hearing aid profile selections. For example, the instructions may cause the processor to adjust the hearing aid profile periodically, reducing power consumption by making adjustments infrequently. Since the acoustic environment of the user can change rapidly, an assumption that periodic profile adjustments are suitable for most hearing aid users, made in the interest of power conservation, can result in a subpar hearing experience in a variety of acoustic environments.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of systems, hearing aids, computing devices, and methods are described below that allow for automatic and/or user-based updates to a hearing aid profile (sound-shaping profile) of a hearing aid. In an example, the hearing aid and the computing device communicate through a radio frequency communication channel, wirelessly, to exchange data that can be used by one or both devices to update a hearing aid profile executed by a digital signal processor of the hearing aid to shape sounds to compensate for the user's hearing deficiency. The computing device can be any electronic device including a processor, a memory, and a transceiver for communicating data to a hearing aid through a wireless (radio frequency) communication channel. In an embodiment, the hearing aid detects a change in the acoustic environment of the user that is significant enough to warrant adjusting the hearing aid profile. In response to detecting the change, the hearing aid can switch to a different hearing aid profile, either by retrieving a more suitable hearing aid profile from its local memory or by sending a request or alert to the computing device, which has other stored hearing aid profiles from which to choose. In some instances, the request or alert includes sound samples or other information corresponding to the detected change, which information is used by the computing device to select a suitable hearing aid profile from those stored in its memory. The computing device then sends the suitable hearing aid profile to the hearing aid for use in shaping sounds to compensate for the user's hearing deficiency. An example of a system that includes a hearing aid and a computing device configured to communicate through a wireless communication channel is described below with respect to FIG. 1.

Figure 1:
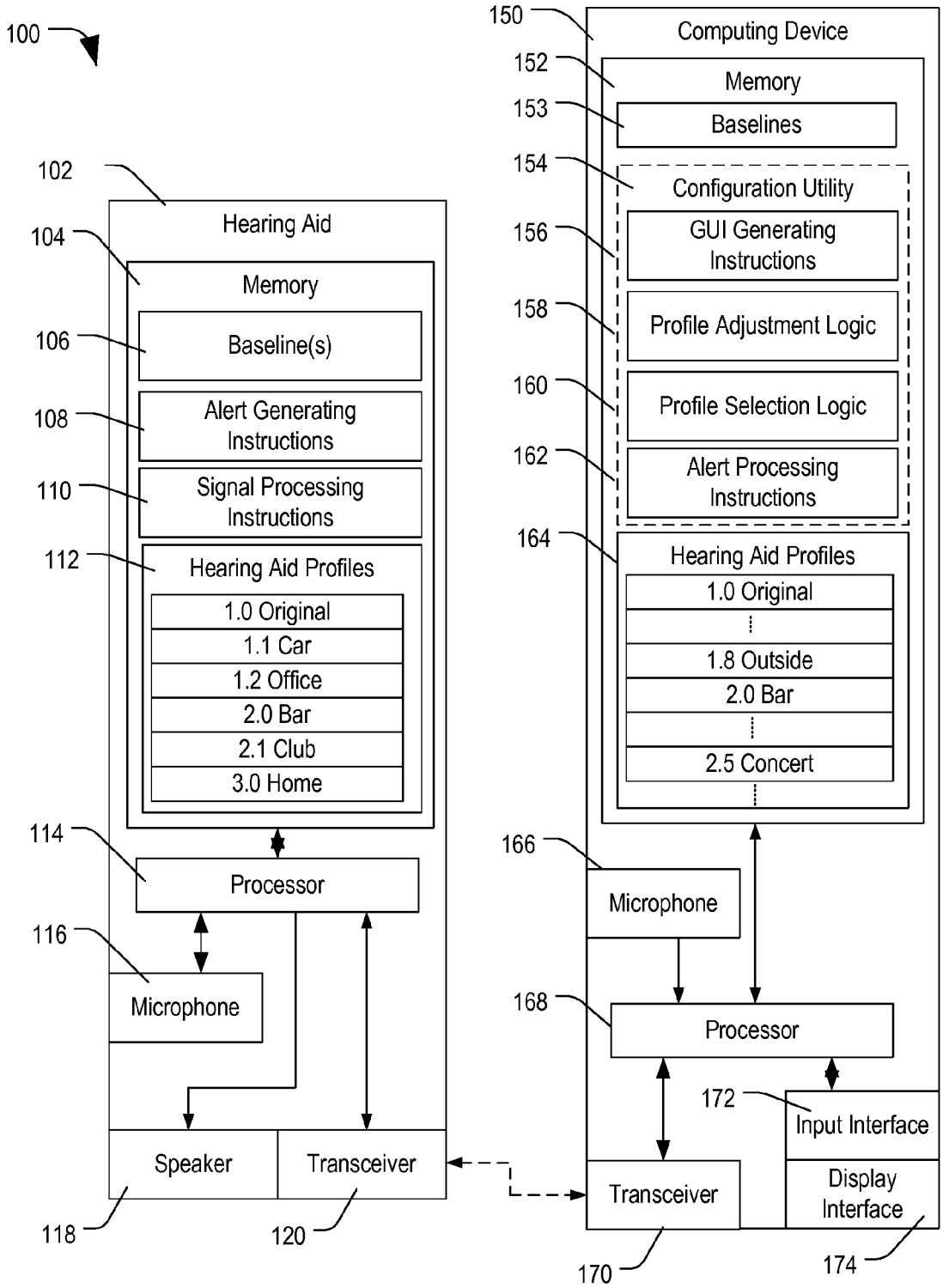
FIG. 1 is a block diagram of an embodiment of a system including a hearing aid and computing device adapted to select a hearing aid profile.

FIG. 1 is a block diagram an embodiment of a system 100 including a hearing aid 102 adapted to communicate with a computing device 150, one or both of which may be adapted to generate a hearing aid alert. Hearing aid 102 includes a processor 114 coupled to a memory 104. Memory 104 stores processor executable instructions including signal processing instructions 110, alert generating instructions 108, at least one baseline 106, and one or more hearing aid profiles 112. As used herein, the term "baseline" refers to a waveform, vector, or other value associated with a hearing aid profile that can be used to identify a hearing aid profile based on a sound sample. In an example, a baseline may be generated using a hearing aid profile, and a sound sample may be processed using the hearing aid profile to produce one or more values that can be used determine if a different hearing aid profile may be more suitable for shaping sounds for the user in the particular acoustic environment.

Hearing aid 102 further includes one or more microphones 116 (microphone 116 may be a single microphone or multiple microphones working in conjunction to detect sound) coupled to processor 114 and configured to receive environmental noise or sounds and to convert the sounds into electrical signals. One or more microphones 116 provides the electrical signals to processor 114, which processes the electrical signals according to a hearing aid profile associated with the user to produce a modulated output signal that is customized to a user's particular hearing ability. Hearing aid 102 further includes a speaker 118 coupled to processor 114 and for reproducing the modulated output signal as an audible sound at or within an ear canal of the user.

Hearing aid 102 further includes a transceiver 120, which is adapted to communicate with computing device 150 through a communication channel. The transceiver 120 is a radio frequency transceiver configured to send and receive radio frequency signals, such as short-range wireless signals. Such short-range wireless signals can include Bluetooth® protocol signals, IEEE 802.11 family protocol signals, or other standard or proprietary wireless protocol signals.

As used herein, the term "computing device" or "computing system" refers to an electronic device that includes a processor configured to execute instructions, which may be stored in a memory, such as a memory 152, a read-only memory (ROM) or loaded from a non-volatile memory into a random access memory (RAM) for execution. In an example, computing device 150 is a personal digital assistant (PDA), a smart phone, a cell phone, a portable computer, tablet computer or another type of computing device adapted to send and receive radio frequency signals according to any protocol compatible with hearing aid 102. Representative examples of computing device 150 includes the Apple iPhone®, which is commercially available from Apple, Inc. of Cupertino, Calif. or Blackberry®, available from Research In Motion Limited of Waterloo, Ontario. Other types of mobile communication devices with short range wireless capability can also be used.

Computing device 150 includes a memory 152, which is accessible to a processor 168. Memory 152 stores a plurality of instructions that are executable by processor 168, including graphical user interface (GUI) generator instructions 156, profile adjustment logic 158, profile selection logic 160, alert processing instructions 162, and a plurality of hearing aid profiles 164. Computing device 150 further includes a transceiver 170, which is coupled to processor 168 and configured to send and receive data packets to and from hearing aid 102 through the communication channel wirelessly.

Computing device 150 also includes a user interface including a display interface 174 and an input interface 172. Display interface 174 is configured to display information to a user. In an example, display interface 174 includes a liquid crystal display (LCD), which can be used to display a text, graphics, or any combination thereof. Input interface 172 can include a keypad, keyboard, mouse, stylus, a touch-sensitive interface, or some combination thereof, through which a user can provide user input to computing device 150. In some embodiments, a touch screen display may be used, in which case display interface 174 and input interface 172 may be combined.

As mentioned above, both hearing aid 102 and computing device 150 include memory devices to store hearing aid profiles. As used herein, the term "hearing aid profile" refers to a collection of acoustic configuration settings for hearing aid 102, which are used by processor 114 within hearing aid 102 to shape acoustic signals to compensate for the user's hearing deficiency. Each of the hearing aid profiles 112 and 164 are based on the user's hearing characteristics and designed to compensate for the user's hearing loss or otherwise shape the sound received by one or more microphones 116. For example, a hearing aid profile can include gain settings and frequency settings for modulating sound-related signals into a modulated form that is suitable for reproduction by speaker 118 for the user to hear properly.

In addition to modulating sound to compensate for a particular user's hearing deficiency, at least some hearing aid profiles may be adjusted to provide sound filtering suitable for a particular acoustic environment. In particular, the one or more parameters are configurable to customize the sound shaping and to adjust the response characteristics of hearing aid 102, so that signal processor 114 can apply a customized hearing aid profile to a sound-related signal to compensate for hearing deficits of the user or otherwise enhance the sound-related signals for the particular sound environment. Such parameters can include signal amplitude and gain characteristics, signal processing algorithms, frequency response characteristics, coefficients associated with one or more signal processing algorithms, or any combination thereof. In some instances, the hearing aid profile includes instructions stored in memory 104 and executable by the signal processor 114, and the one or more parameters can be configured by replacing or modifying the instructions.

In general, either hearing aid 102 or computing device 150 may initiate a hearing aid profile configuration process. In a first example, in response to receiving the alert, processor 114 executes signal processing instructions 110 to apply a selected hearing profile from hearing aid profiles 112 to shape sound-related electrical signals received from one or more microphones 116. Further, processor 114 executes alert generating instructions 108 to capture one or more sound samples from the sound-related electrical signals. As used herein, the term "sound sample" refers to a digital representation of the user's current acoustic environment as derived from the electrical signals produced by one or more microphones, such as one or more microphones 116 or microphone 166. In an example, the one or more microphones 116 captures analog sound from the user's environment and converts the analog sound into an analog electrical signal. The sound sampling can be captured periodically, randomly, or in response to a trigger to sample the sound-related electrical signal. The trigger may be a user-initiated trigger, a trigger from processor 114 executing alert generating instructions 108, or a trigger from computing device 150. The sound-related electrical signal is converted to a digital signal by an analog-to-digital converter (not shown) to produce a sound sample that consists of a digital representation of the acoustic environment.

Processor 114 executes alert generating instructions 108 to compare the sound sample to baseline 106 to determine a difference. In particular, processor 114 executes the alert generating instructions 108 to determine if a change in the acoustic environment of the user has taken place. Alert generating instructions 108 include comparison logic and instructions to compare the sound sample to the baseline to determine if a difference between them exceeds a threshold. The threshold may be a frequency difference threshold, an amplitude difference threshold, a background noise threshold, another threshold, or any combination thereof. In an embodiment, the threshold amounts and types can be selected and modified by the user.

If processor 114 determines that the difference between the sound sample and the baseline exceeds the threshold, processor 114 generates an alert and sends the alert to computing device 150 through the wireless communication channel. The alert can include commands, instructions, and/or data to initiate a hearing profile configuration process on computing device 150. In an example, the alert may include commands to run predetermined programs, update software, or select between signal processing algorithms. The data may include the sound sample, current configuration information, the currently selected hearing aid profile, other data, or any combination thereof. In response to receiving the alert, processor 168 of computing device 150 executes alert processing instructions 162 as discussed in detail below.

In addition to sending the alert, signal processor 114 also stores the sound sample used in the comparison into memory 104. In an example, signal processor 114 is configured to control memory 104 to overwrite baseline 106, replacing it with the sound sample, such that the sound sample becomes the new baseline 106. In an alternative embodiment, memory 104 may store sound samples in a first-in first-out (FIFO) portion of memory 104, such that the sound sample may be added to the FIFO portion, displacing a previously stored sound sample. In a FIFO implementation, processor 114 may compare the sound sample to one or more of the sound samples (baselines 106) stored in memory 104. In a second example, computing device 150 initiates the configuration process. Computing device 150 produces sound-related signals using microphone 166 and samples the sound-related signals to produce sound samples, which are compared to baselines 153 stored in memory 152. The sampling and comparing process may be controlled by alert processing instructions 162 executing on processor 168. When a difference between the sound sample and baselines 153 exceeds a threshold, processor 168 generates the alert. In addition to generating an alert, a signal may be sent to hearing aid 102 through the communication channel to update baseline 106 with data related to the change in acoustic environment.

In either example, in response to the alert, processor 168 extracts the content of the alert indicating detection of a change in acoustic environment and begins the hearing aid profile configuration process. Processor 168 may execute commands, access one or more instructions from memory 152, process data, or any combination thereof in response to the alert. In particular, processor 168 may execute graphical user interface (GUI) generating instructions 156 to generate a GUI for display at display interface 174, profile selection logic 160 to select one or more possible hearing aid profiles from hearing aid profiles 164 that substantially match the acoustic environment indicated by the alert and to provide data related to the one or more possible hearing aid profiles to the GUI for display at display interface 174. The one or more possible hearing aid profiles may include a recommended hearing aid profile, which may be determined automatically by processor 168 based on a comparison between the sound sample data in the alert and hearing aid profile data stored in memory 152. Once the GUI is displayed, processor 168 may execute notification instructions to notify the user that the GUI is available to update the hearing aid profile. Such a GUI ready notification may include an audible sound produced through a speaker of computing device 150 (such as speaker), a display icon such as a flashing image on display interface 174, a flashing light-emitting diode or other visible indicator, or a tactile indicator, such as a vibration caused by a transducer (such as transducer), or some combination thereof. In another embodiment, processor 168 generates an audio alert for communication to hearing aid 102 for reproduction by speaker 118. The GUI ready notification may be used by hearing aid 102 to produce an audible sound (such as a click), a change in audible sound (such as a moment of silence), a vibration, or other user-detectable notification, to indicate to the user that a user interface of computing device 150 is available for user input to adjust a hearing aid profile of hearing aid 102

Once the GUI is available, the user may interact with input interface 172 to select or modify one of the hearing aid profiles 164, or to create a new hearing aid profile from one of the hearing aid profiles 164 to suit the environment. The user can interact with input interface to transmit the selected, modified, or new hearing aid profile to the hearing aid 102. In an example, once a particular hearing profile is selected, computing device 150 sends a signal to hearing aid 102. The signal may include the new profile, coefficients to update a current signal processing algorithm, data, or any combination thereof, which can be used by processor 114 of hearing aid 102 to process sounds.

In a second embodiment, processor 168 can execute profile selection logic 160 to automatically select a hearing aid profile from hearing aid profiles 164 that is better suited to the user's changed acoustic environment than the current hearing aid profile executed by processor 114 of hearing aid 102. In response to the alert, processor 168 selects a hearing aid profile to update hearing aid 102 by comparing the data received in the alert to data associated with each of the available hearing aid profiles 164. In one example, the alert can include a sound sample. Processor 168 executes profile selection logic 160 to compare the sound sample to values associated with hearing aid profiles 164. In an example, the value is a hash value derived by compressing the hearing aid profile, selectively comparing predominant frequencies of the sample to frequency data from hearing aid profiles 164, or by utilizing a key value system that involves comparing a series of parameters of the sound sample, such as frequency, amplitude, and white noise, to corresponding parameters derived from hearing aid profiles 164.

In one example, the comparing process continues until processor 168 finds a first hearing aid profile whose absolute value of the difference between the hearing aid profile and the sound sample is within a threshold (i.e., within a suitable range). If no hearing aid profile matches the sound sample, processor 168 may present the user with an opportunity to modify one of the existing profiles via graphical user interface generated by GUI generating instructions 156.

In a second example, processor 168 may use an iterative process, first comparing data from the alert to a frequency difference threshold to determine a set of acceptable hearing aid profiles then comparing the data from the alert to a background noise threshold to further reduce the number of acceptable hearing aid profiles until one hearing aid profile is selected as a "best match" hearing aid profile.

In still another example, where none of the hearing aid profiles 164 are suitable for the user's acoustic environment, processor 168 can execute an update algorithm to create a new hearing aid profile. For example, processor 168 may select a hearing aid profile from hearing aid profiles 164 that has a smallest variation from the threshold and then performs a series of adjustments to the hearing aid profile to adjust the hearing aid profile for the particular acoustic environment based on the data in the alert. Then, processor 168 can transmit the updated hearing aid profile to hearing aid 102 and store the updated hearing aid profile as a new entry within hearing aid profiles 164.

System 100 provides the user with the ability to modify the sound-shaping hearing aid profile executed by processor 114 within hearing aid 102 in situ and as desired. Further, computing device 150 can be configured to provide a selected hearing aid profile to hearing aid 102 and either manually in response to user input or automatically in response to receiving the alert. Further, hearing aid 102 may store frequently used hearing aid profiles. Thus, when a user frequents a particular environment on a regular basis, the user may decide to establish a custom profile for that particular environment which can be maintained in memory 104 of hearing aid 102 and/or in memory 152 of computing device 150, enhancing the performance of hearing aid 102 and improving the user's overall acoustic experience. As mentioned above, the user may establish any number of custom profiles and may create such profiles at any time by editing a preexisting profile or by creating a new one.

While FIG. 1 depicts system 100 in block form, it should be understood that hearing aid 102 is designed to be worn on a user's ear. An example of an external, behind-the-ear hearing aid is described below with respect to FIG. 2 that can be used with system 100.

Figure 2:
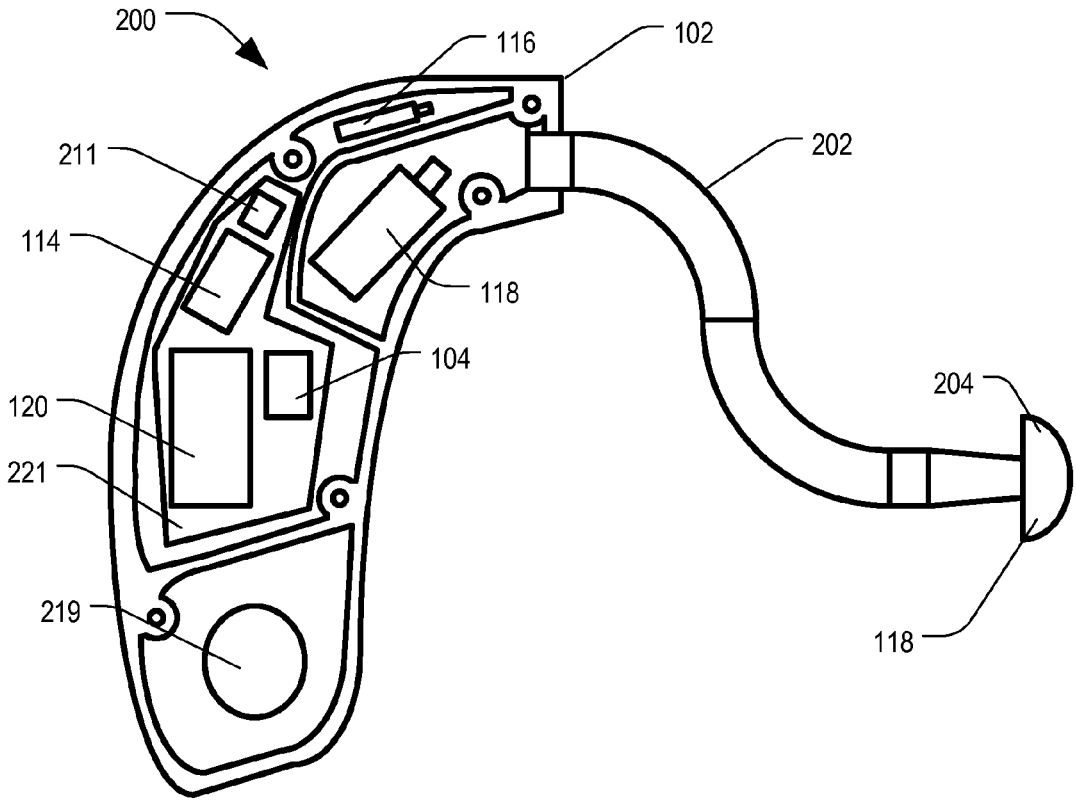
FIG. 2 is a cross-sectional view of a representative embodiment of an external hearing aid including logic to provide an alert for triggering selection of a hearing aid profile.

FIG. 2 is a cross-sectional view of a representative embodiment 200 of an external hearing aid system 102 including logic to provide an alert. Hearing aid 102 includes one or more microphones 116 coupled to processor 114 of circuit 221 and configured to convert sounds into electrical signals. Circuit board 221 includes processor 114, transceiver 120, a system microcontroller 211, and in some instances memory 104 useful for storing hearing aid profiles and instructions executable by processor 114. Further, hearing aid 102 includes an ear tube 202 coupled to an ear bud 204, which includes speaker 118. Ear tube 202 is flexible and designed to couple ear bud 204 to circuit board 221. Ear bud 204 is sized to fit in the user's ear, and speaker 118 reproduces the shaped audio signal from processor 114 to the user's ear. Further, hearing aid 102 includes a battery 219 to supply power to the other components.

During operation, processor 114 executes signal processing instructions are to apply a selected hearing aid profile to the electrical signals produced by one or more microphones 116, shaping the sound-related electrical signals to produce a shaped (modulated) audio signal that compensates for the user's hearing deficiencies. In an embodiment, processor 114 executes signal processing instructions 110 to capture one or more sound samples from the sound-related electrical signals and compares the one or more sound samples to baselines 106 stored in memory 104. In an example, processor 114 subtracts the sound sample from a recorded sound sample (the baseline) and compares the absolute value of the difference to the threshold. The threshold may be a frequency difference threshold, an amplitude difference threshold, a background noise threshold, or a threshold that represents any combination thereof. In an embodiment, the threshold amounts and types can be selected and modified by the user, for example, by accessing the user interface of computing device 150. If processor 114 determines that the difference between the sound sample and the baseline exceeds the threshold, processor 114 executes alert generating instructions (such as alert generation logic 108 illustrated in FIG. 1) to generate an alert and to send the alert to computing device 150 through the communication channel. Hearing aid 150 may continue performing the sound shaping using a currently selected hearing aid profile selected before the alert was generated until an update is received from computing device 150.

In an alternative embodiment, processor 114 executes instructions to perform a hearing aid profile selection. In this instance, memory 104 includes a list of recently used hearing aid profiles or a list of most frequently used hearing aid profiles, and processor 114 selects a hearing aid profile from the list based on the sound samples to provide a quick update process. For example, processor 114 could compare the sound sample to a value assigned to each of the hearing aid profiles stored in memory 104 to determine if one of the stored profiles can shape the sounds to produce a satisfactory sound profile. In this instance, hearing aid 102 only sends an alert when no satisfactory hearing aid profile is available in memory 104.

If processor 114 determines that an alert should be generated and sent to computing device 150, processor 114 may select an interim hearing aid profile from memory 104 to utilize until a hearing aid update has been received from computing device 150. The interim hearing aid profile would then be replaced once the hearing aid update is received from computing device 150.

In another embodiment, rather than sending an alert to trigger a hearing aid update, hearing aid 102 may send a request for a specific hearing aid profile stored in memory 152 of computing device 150. In this embodiment, hearing aid 102 would determine a change in the acoustic environment described above. However, once the change in environment was determined, processor 114 would access memory 104, which would maintain a table of usability values and hearing aid profile identifiers for a large number of the hearing aid profiles stored on computing device 150. The table could include values for all available hearing aid profiles, since the table values would use less memory than the full hearing aid profiles.

The usability value represents a comparison value associated with a particular hearing aid profile that could be used to compare to the sound samples to determine if the hearing aid profile would be acceptable for a given sound environment. The usability value could be a numeric value representative of a compressed sound sample, a vector, or a threshold value, such as any of the thresholds described above. The identifier is a unique value that is used to uniquely identify one of the plurality of hearing aid profiles 164 in memory 152 on computing device 150. For example, processor 114 in hearing aid 102 is configured to cycle through the usability values, comparing each one to the threshold to identify an acceptable hearing aid profile. When processor 114 identifies an appropriate hearing aid profile, it sends an alert including the identifier of the hearing aid profile to computing device 150, which uses the identifier to retrieve the hearing aid profile and to provide the requested hearing aid profile to hearing aid 102.

It should be understood that, while hearing aid system 200 illustrates an external "wrap-around" hearing aid 102, the user-configurable processor 114 can be incorporated in other types of hearing aids, including hearing aids designed to be worn behind the ear or within the ear canal, or hearing aids designed for implantation. The embodiment of hearing aid 102 represents only one of many possible implementations with which the user-configurable signal processor may be used.

Figure 3:
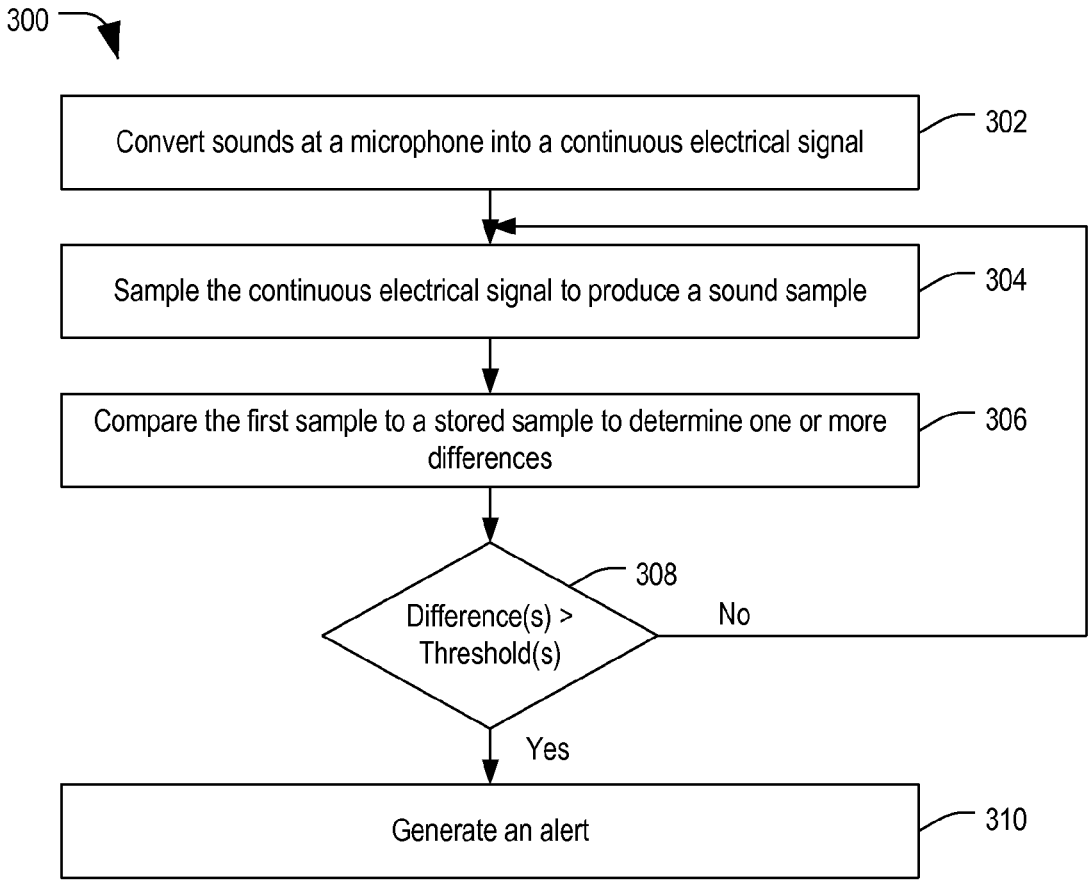
FIG. 3 is a flow diagram of an embodiment of a method of generating an alert to initiate selection of a hearing aid profile.

FIG. 3 is a flow diagram of an embodiment of a method 300 of generating an alert. At 302, sound at microphone(s) (116 or 166) is converted into a continuous electrical signal. Advancing to 304, the continuous electrical signal is sampled to produce a sound sample. In one embodiment, the sound sample is produced using an analog-to-digital converter (not shown), creating a digital representation of the sound (i.e., a sound sample). In an alternative embodiment, the electrical signals may be sampled by an analog sample-and-hold circuit. The continuous signal may be sampled periodically, randomly, or in response to a trigger. The trigger may be a user-initiated trigger or an automatically generated trigger.

Moving to 306, the first sample is compared to a stored baseline sample (or usability value) to determine one or more differences. Baselines may be stored in memory 104 of hearing aid 102 or in memory 152 of computing device 150. Proceeding to 308, if a difference between the sample and the baseline is less than a threshold, method 300 returns to 304 and the continuous electrical signal is sampled to produce another sound sample. In some instances, a delay may occur before another sound sample is taken. For example, in an instance where samples are taken periodically, the next sound sample may not be captured until the period expires.

Otherwise, at 308, if the difference is greater than the threshold, method 300 advances to 310 and an alert is generated. The alert, as discussed above, can include data related to the sound sample, commands, or other data. In some instances, the alert can include delta information related to the difference between the sound sample and a baseline, and/or other information. If hearing aid 102 produces the alert, hearing aid 102 transmits the alert through the communication channel to computing device 150 to initiate the configuration process. In response to the alert, computing device 150 enters the configuration process. Alternatively, if the alert is generated by computing device 150, computing device 150 can treat the alert as an interrupt or other trigger to execute profile adjustment logic 158 and/or profile selection logic 160 to adjust/select a suitable profile for the acoustic environment and to provide the suitable profile to the hearing aid 102.

Figure 4:
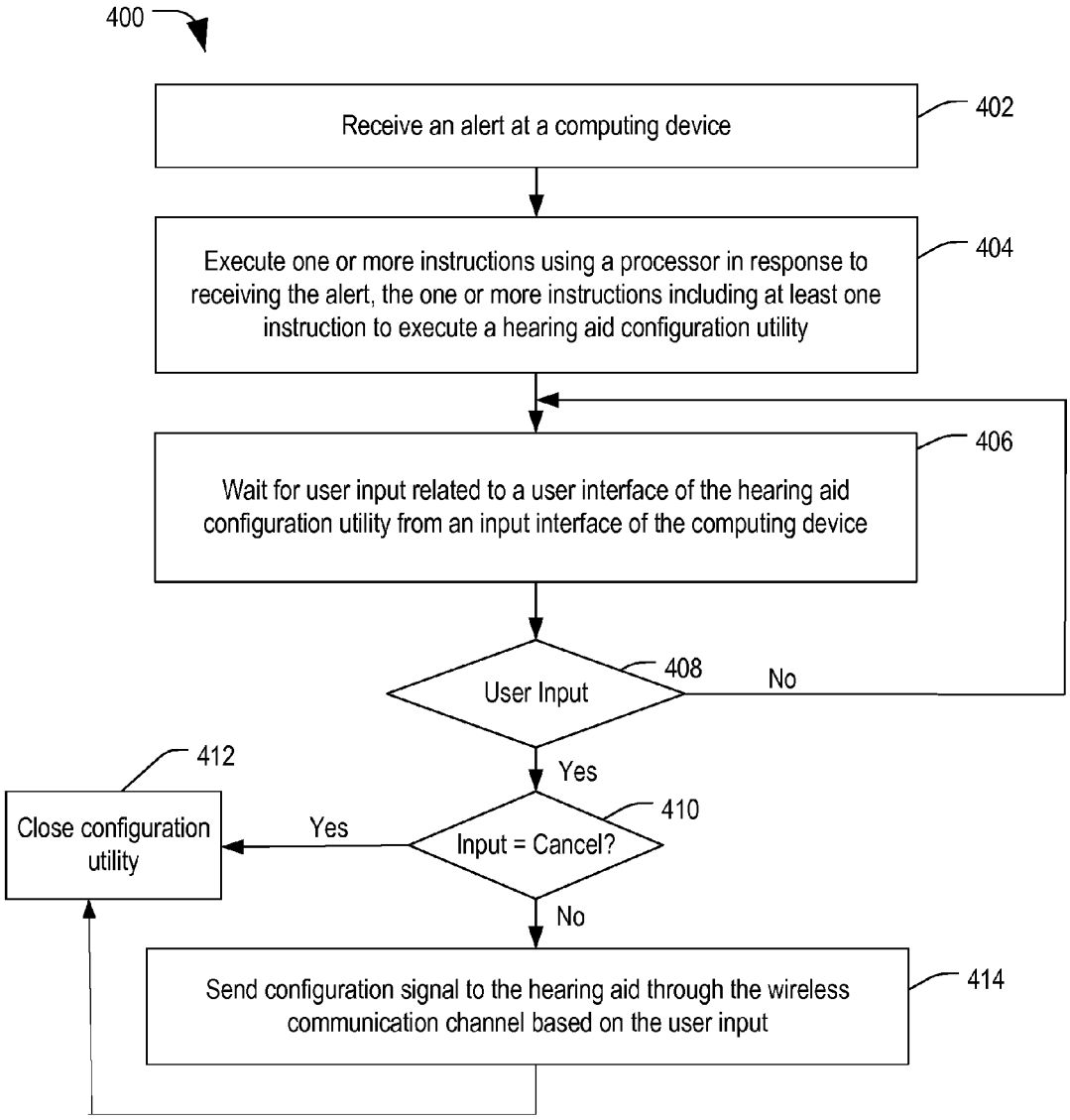
FIG. 4 is a flow diagram of an embodiment of a method of selection of a hearing aid profile in response to receiving the alert of FIG. 3.

FIG. 4 is a flow diagram 400 of the steps taken by a computing device in response to receiving the alert. At 402, computing device 150 receives an alert. The alert may include instructions that can be executed by processor 168, commands to access instructions stored in memory 152, data related to a sampled sound, other data, or any combination thereof. Advancing to 404, executes one or more instructions using a processor in response to the alert, where the one or more instructions include at least one instruction to execute a hearing aid configuration utility 154 (which may include instructions, such as GUI generator instructions 156, profile adjustment logic 158, profile selection logic 160, alert processing instructions 162, or other instructions). In an example, processor 168 executes the GUI generator instructions 156 to produce a graphical user interface to allow the user to select or modify a hearing aid profile. The graphical user interface can be rendered within an Internet browser window or can be a stand-alone software application including text and user-selectable elements, such as buttons, check boxes, pull-down menus, and the like. Moving to 406, the system waits for user input related to the user interface of the hearing aid configuration utility 154 from input interface 172 of computing device 150.

Proceeding to 408, if the user does not provide input, method 400 will return to 406 and continue waiting for user input. In the alternative, if no user input is received for a period of time at 408, processor 168 may shut down configuration utility 154 and send no configuration signal to hearing aid 102. Otherwise, if the user does provide input using the user interface at 408, the method 400 advances to 410. If, at 410, the user input is a cancel command, the method continues to 412 and configuration utility 154 is closed and no configuration signal is sent to hearing aid 102.

Otherwise, at 410, if the user input is not a cancel command, the method advances to 414, and a configuration signal is sent to hearing aid 102 through the wireless communication channel based on the user input. In an example, the user input includes a selection related to a new hearing aid profile from a list of possible hearing aid profiles to install into hearing aid 102. After the configuration signal is sent, processor 168 closes configuration utility 154 as in 412.

In the alternative, configuration utility 154 at block 404 may run a process to select the most suitable hearing aid profile stored in memory 152 or to execute an algorithm to create a new hearing aid profile based on the closest currently-saved hearing aid profile. In this alternative, there is no need for the user input at blocks 406-410 and configuration utility 154 will close once the process is complete, as in 412. By utilizing the alert process and computing device 150 in this manner, many more hearing aid profiles become available to more finely tune the hearing experience to the user's specific environment without the use of the user input.

Further, it should be appreciated that method 400 may include additional blocks, allowing for independent configuration/selection of right and left hearing aid profile. In some instances, a user may wish to selectively alter one or both of the hearing aids. In one instance, the user may adjust a right hearing aid using a first hearing aid profile and adjust a left hearing aid using a second hearing aid profile. In an embodiment, separate right ear profiles and left ear profiles are provided, which are configured differently to compensate for the particular hearing deficits of the users right and left ears, respectively. In this instance, method 400 may be repeated for left and right hearing aids. Further, adjustment to one hearing aid does not necessarily cause an adjustment to the other hearing aid. In some instances, a user may wish to selectively adjust the hearing aids for a particular environment, which may or may not require adjustments to both hearing aid profiles.

Figure 5:
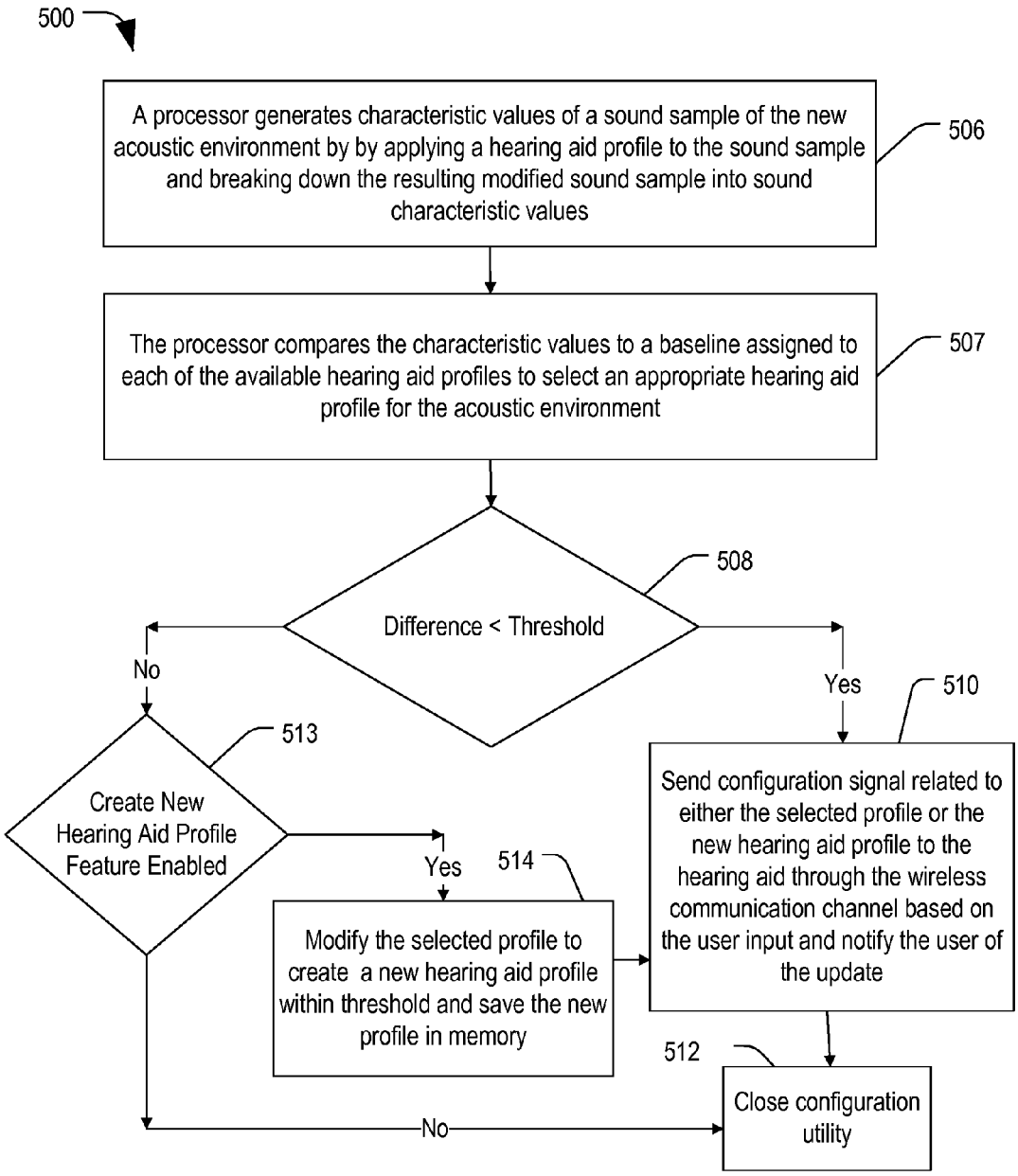
FIG. 5 is a flow diagram of an embodiment of a method of automatic selection of a hearing aid profile in response to detection of a change in the acoustic environment.

FIG. 5 is a flow diagram of method 500 taken by computing device 150 as it automatically selects a hearing aid profile for use in response to a change in the acoustic environment. At 506, processor 168 generates characteristic values of a sound sample of the new acoustic environment by applying a hearing aid profile to the sound sample and breaking down the resulting modified sound sample into sound characteristic values. At 507, processor 168 compares the characteristic values to a baseline assigned to each of the available hearing aid profiles 164 to select an appropriate hearing aid profile for the acoustic environment. In an embodiment, the characteristic values and the baselines may be represented by a frequency range, a peak amplitude, white noise level or other sound characteristics. In another embodiment, the characteristic values may include a wide range of values corresponding to the acoustic environment, and the baseline includes selected values that are important for determining suitability of a particular hearing aid profile for an acoustic environment. The sound sample may be received from hearing aid 102 or may be taken using microphone 166 of computing device 150.

Proceeding to 508, processor 168 determines whether the characteristic values differ from the baseline by more than a threshold. For example, processor 168 may compare a characteristic frequency range value of the sound sample to a frequency range associated with the baseline of the hearing aid profile. In a second example, processor 168 may subtract a particular characteristic frequency of the sound sample from one or more stored frequency values of the baselines and use an iterative process to compare the difference to a frequency difference threshold to determine a set of acceptable hearing aid profiles. In yet another example, processor 168 can determine a background noise parameter of the sound sample and compare it to a background noise threshold associated with the baseline of a hearing aid profile and baselines of the plurality of hearing aid profiles 164 and 112. Other methods for computationally determining whether a sound sample indicates that a more suitable hearing aid profile should be selected may also be used. Further, it should be understood that multiple types of characteristic values could be utilized consecutively, concurrently, or iteratively to determine suitability of a hearing aid profile to the acoustic environment. Processor 168 may perform the comparison in a FIFO order, a ranked order, a most used order, or a variety of other known ordering systems stopping when it finds a first hearing aid profile that is within a threshold range of a value of the sound sample.

If processor 168 selects a hearing aid profile whose characteristic values are suitably close to the threshold when compared to the baseline, method 500 proceeds directly to 510. At 510, computing device 150 sends the configuration signal including the selected hearing aid profile to hearing aid 102 through the communication channel. Once the configuration signal is sent, method 500 will proceed to 512 and processor 168 closes the configuration utility.

In the alternative, if (at 508) processor 168 does not find a hearing aid profile whose characteristic values are suitably close to the threshold when compared to the baseline, the method 500 advances to 513 and processor 168 determines whether a "Create New Hearing Aid Profile" feature is enabled. If it is not enabled, the method 500 advances to 512 and processor 168 closes the configuration utility. Otherwise, if the feature is enabled at 513, the method 500 continues to 514 and processor 168 executes instructions to modify a hearing aid profile such that, in its altered state, its usability values compared to the characteristic values are suitably close to the threshold. For example, processor 168 may start by selecting the hearing aid profile from hearing aid profiles 164 in memory 152 whose value of the difference between the usability value and the characteristic values are closest to falling within the threshold. Once processor 168 has selected a hearing aid profile it begins a process of altering the hearing aid profile settings until the hearing aid profile value is within the threshold. After the alterations to the hearing aid profile are complete, processor 168 stores the hearing aid profile in memory 152 and proceeds to 510 and sends the hearing aid profile to the hearing aid 102, as described above.

The alterations to the selected hearing aid profile may take a number of forms. For example, processor 168 may execute instructions to compare the selected hearing aid profile to the user's hearing profile to adjust settings based on the user's unique hearing loss. In a second example, processor 168 may execute instructions to run a hearing aid profile update based on data parameters such as a sound shaping equation or a set of coefficients for a sound shaping equations or a combination of the two.

System 100 depicted in FIG. 1 allows for multiple hearing aid profiles to be distributed between memories 104 and 152, making it possible to retain a large number of customized hearing profiles that can be accessed, as needed, either automatically or by the user to configure hearing aid 102. In an example, the user can configure hearing aid 102 during operation, without visiting a hearing professional, using a general purpose computing device, such as a cell phone. Further, hearing aid 102 and computing device 150 can cooperate to update hearing profiles within hearing aid 102 using alerts and update packets.

By sending alerts to the hearing aid 102, computing device 150 can notify the user when a recommended hearing aid profile is available to adjust the performance of hearing aid 102. Alternatively, hearing aid 102 can send an alert to computing device 150 to retrieve a better hearing aid profile, to request a better hearing aid profile, or to alert computing device 150 that a change in the acoustic environment is detected. In response to the alert from hearing aid 102, computing device 150 may sample the acoustic environment to produce sound samples, which can then be used to select a better hearing aid profile or to update the hearing aid profile of hearing aid 102. Further, a user may access computing device 150 to configure new profiles and/or to update the hearing aid 102, without requiring the user to visit a health professional.

In a first embodiment, hearing aid 102 is configured to automatically detect a change in the acoustic environment that is significant enough to warrant changing the currently selected hearing aid profile, as previously discussed. In an embodiment, hearing aid 102 searches memory 104 to see if a suitable hearing aid profile for the current acoustic environment is already stored in hearing aid profiles 112. If it is, processor 114 applies the locally stored profile to shape sounds. If not, processor 114 sends a request to computing device 150 to retrieve a suitable hearing aid profile from hearing aid profiles 164. In response to the request, computing device 150 may locate a suitable hearing aid profile within its memory 152 in hearing aid profiles 164, retrieve the suitable hearing aid profile, and send it to hearing aid 102 through the wireless communication channel. Processor 114 within hearing aid 102 may then store the suitable hearing aid profile in its memory 104 (for example by overwriting a last-used hearing aid profile stored in memory 104), loads the suitable hearing aid profile, and uses it to process sounds. In this example, processor 114 and memory 104 may utilize a first in-first out method for storing the hearing aid profiles 112 within the limited hearing aid memory space available. Other file storage strategies may also be used, depending on available memory and depending on the changing acoustic environment.

In a second embodiment, the user may interact with computing device 150 (e.g., the user's cell phone) to access an application stored on computing device 150. Through a user interface rendered by processor 168 in response to user selection of the application, the user can select a new hearing aid profile from hearing aid profiles 164 and apply the selected hearing aid profile to hearing aid 102. In a third embodiment, the computing device 150 can trigger the hearing aid profile update by automatically detecting a change in the acoustic environment and communicating with hearing aid 102 to determine whether a change in hearing aid profiles is appropriate.

While the embodiments described above with respect to FIGS. 1-5 generally describe communications between a computing device and a single hearing aid, it should be understood that many users wear a pair of hearing aids and that the computing device 150 can be used to selectively update a hearing aid profile for use by either hearing aid. Further, computing device 150 may store left and right ear hearing aid profiles, particularly for users that have different hearing impairments in the left ear as compared to the right ear. In general, computing device 150 makes it possible to independently update the hearing aid profiles for the right hearing aid and the left hearing aid, and to selectively provide the changes to the right and left hearing aids.

In conjunction with the systems, hearing aids, and methods described above with respect to FIGS. 1-5, a system is described that includes a hearing aid and a computing device, which are configured to communicate wirelessly. Both the hearing aid and the computing device are configured to store hearing aid profiles, and the hearing aid is configured to apply the hearing aid profile to shape sounds to compensate for the user's hearing deficiency. Computing device is configured to selectively update the currently selected hearing aid profile based on samples of the sound environment (taken by the hearing aid or the computing device), either automatically or in response to user input. The computing device typically has a bigger memory than the hearing aid, making it possible to store any number of hearing aid profiles suitable for a wide variety of acoustic environments. The computing device can communicate with the hearing aid to update the hearing aid profile, as needed, so that a processor of the hearing aid can apply a new hearing aid profile suitable for the particular acoustic environment.

Although the present invention has been described with reference to preferred embodiments, workers skilled in the art will recognize that changes may be made in form and detail without departing from the scope of the invention.

What is claimed is:

1. A method comprising:

detecting, at a hearing aid, a change in an acoustic environment by comparing characteristics of a new acoustic environment to a baseline, the baseline including a plurality of frequency and amplitude values over a frequency range and representative of a previous acoustic environment;

in response to detecting the change in the acoustic environment, sending an alert to a computing device through a wireless communication channel;

receiving data at the hearing aid, the data including configuration data and a second baseline including a plurality of frequency and amplitude values over the frequency range representative of the new acoustic environment;

selectively updating a hearing aid profile in response to receiving the configuration data to produce a modified hearing aid profile;

applying the modified hearing aid profile using a processor of the hearing aid to shape an audio output; and replacing the baseline with the characteristics of the new acoustic environment.

2. A computing device comprising:

a transceiver configured to communicate with a hearing aid through a wireless communication channel;

a memory to store a plurality of hearing aid profiles and a hearing aid configuration utility, each of the plurality of hearing aid profiles being associated with one or more waveforms represented by a plurality of amplitude thresholds at a plurality of frequencies, each of the one or more waveforms representative of sound environments suitable for use with the associated hearing aid profile;

a display interface to display a graphical user interface (GUI) as part of the hearing aid configuration utility; and a processor having access to the memory, the processor configured to execute the hearing aid configuration utility to:

select one or more hearing aid profiles from the plurality of hearing aid profiles based on the waveforms and a sound sample captured from a current acoustic environment;

present the GUI on the display interface, the GUI to provide the one or more hearing aid profiles as user selectable options; and output a GUI ready notification to indicate to the user that the GUI is available.

3. The computing device of claim 2, wherein the computing device comprises at least one of a cell phone, a portable music player, a PDA, and a tablet computer.

4. The computing device of claim 2, wherein the processor executes the hearing aid configuration utility to detect a change in an acoustic environment by comparing characteristics of the acoustic environment to the one or more waveforms and to selectively update the hearing aid profile in response to detecting the change.

5. The computing device of claim 2, wherein the processor receives a trigger and executes the hearing aid configuration utility in response to receiving the trigger.

6. The computing device of claim 5, wherein the trigger is received from the hearing aid through the communication channel via the transceiver.

7. The computing device of claim 5, further comprising:

an input interface for receiving a user input; and wherein the trigger comprises the user input.

8. The computing device of claim 2, wherein:

identify a new hearing aid profile from a plurality of hearing aid profiles for the hearing aid based on a difference between characteristic values of the acoustic environment and a plurality of waveforms; and transmit the new hearing aid profile to the hearing aid in response to identifying the new hearing aid profile.

9. The computing device of claim 2, further comprising:

an input interface for receiving a user input; and wherein the GUI includes text and one or more user-selectable elements accessible by a user through the input interface.

10. A hearing aid comprising:

a transceiver configured to communicate with a computing device through a communication channel;

one or more processors configured to shape sounds according to a first hearing aid profile suitable for a first acoustic environment; and a memory storing instructions which when executed by the one or more processors, cause the one or more processors to:

detect a change to a second acoustic environment by comparing acoustic parameters of the second acoustic environment to a baseline including a plurality of frequency and amplitude values representative of the first acoustic environment;

transmit a signal to the computing device through the communication channel in response to detecting the change to the second acoustic environment;

receive from, the computing device, a second hearing aid profile suitable for the second acoustic environment; and replace the baseline with the acoustic parameters of the second acoustic environment.

11. The hearing aid of claim 10, wherein the instructions when executed by the one or more processors cause the one or more processors to detect the change when the acoustic parameters differ from the baseline by more than a threshold amount at two or more frequencies.

12. The method of claim 1, wherein the hearing aid sends the characteristics of the new acoustic environment to the computing device with the alert.

13. The method of claim 1, wherein the hearing aid generates a audio alert at a microphone to indicate that the computing device is available for adjusting a hearing aid profile to suit the new acoustic environment.

14. The method of claim 1, wherein the computing device produces a graphical user interface ready notification at least in part in response to receiving the alert.

15. The method of claim 1, wherein the configuration data includes the modified hearing aid profile.

16. The method of claim 15, wherein the computing device selects the modified hearing aid profile by comparing the characteristics of the new acoustic environment to a plurality of waveforms, each of the plurality of waveforms associated with a hearing aid profile and representative of an acoustic environment.

17. The method of claim 1, wherein the baseline includes at least one of a frequency difference threshold and a background noise threshold.

18. The hearing aid of claim 10, wherein the instructions when executed by the one or more processors cause the one or more processors to shape sounds captured by a microphone according to the second hearing aid profile in response to receiving the second hearing aid profile from the computing device.

19. The hearing aid of claim 10, wherein the baselines includes at least one threshold frequency and at least one threshold amplitude.

20. The hearing aid of claim 10, wherein the instructions when executed by the one or more processors cause the one or more processors to monitor sounds captured by a microphone for the change.

* * * * *